US010717094B2

(12) United States Patent
Takagi

(10) Patent No.: US 10,717,094 B2
(45) Date of Patent: Jul. 21, 2020

(54) BUBBLE DISCHARGING NOZZLE AND BUBBLE DISCHARGING DEVICE

(71) Applicant: Kao Corporation, Tokyo (JP)

(72) Inventor: Yoshimasa Takagi, Suginami-ku (JP)

(73) Assignee: Kao Corporation, Tokyo (JP)

( * ) Notice: Subject to any disclaimer, the term of this patent is extended or adjusted under 35 U.S.C. 154(b) by 259 days.

(21) Appl. No.: 15/579,439

(22) PCT Filed: Jun. 16, 2016

(86) PCT No.: PCT/JP2016/067883
§ 371 (c)(1),
(2) Date: Dec. 4, 2017

(87) PCT Pub. No.: WO2017/002630
PCT Pub. Date: Jan. 5, 2017

(65) Prior Publication Data

US 2018/0141064 A1 May 24, 2018

(30) Foreign Application Priority Data

Jun. 29, 2015 (JP) ..... 2015-130420

(51) Int. Cl.
*B05B 7/00* (2006.01)
*B05B 1/02* (2006.01)
(Continued)

(52) U.S. Cl.
CPC ..... *B05B 7/0037* (2013.01); *A47K 5/14* (2013.01); *B05B 1/02* (2013.01); *B05B 1/14* (2013.01);
(Continued)

(58) Field of Classification Search
CPC ..... B05B 1/02; B05B 7/0037; B05B 7/0062; B05B 7/267; A47K 5/1207; A47K 5/14; A47K 5/16
See application file for complete search history.

(56) References Cited

U.S. PATENT DOCUMENTS 7,543,722 B2 * 6/2009 Yates ..... A47K 5/14 222/135
2002/0153390 A1 * 10/2002 Vlodek ..... B65D 83/205 222/191
(Continued)

FOREIGN PATENT DOCUMENTS

JP 2003-111810 A 4/2003
JP 2006-159092 A 6/2006
(Continued)

OTHER PUBLICATIONS

International Search Report dated Sep. 20, 2016, in PCT/JP2016/067883 filed Jun. 16, 2016.
(Continued)

*Primary Examiner* — Ryan A Reis
(74) *Attorney, Agent, or Firm* — Oblon, McClelland, Maier & Neustadt, L.L.P.

(57) ABSTRACT

A foam discharging nozzle of the invention is a foam discharging nozzle for a foam discharging device, including: a foam diffusion space to which foam produced by mixing a liquid and a gas is supplied from a foam supply opening located on an upper side; and at least one foam discharging opening formed in a bottom portion of the foam diffusion space. The area of the bottom portion of the foam diffusion space is wider than the area of the foam supply opening. The centroid of the foam discharging opening does not match the centroid of a supply opening projected portion formed by
(Continued)

projecting the foam supply opening onto the bottom portion parallel to a central axis of the foam diffusion space.

17 Claims, 7 Drawing Sheets

(51) Int. Cl.

| | |
|---|---|
| ***A47K 5/14*** | (2006.01) |
| ***B05B 7/26*** | (2006.01) |
| ***B05B 1/14*** | (2006.01) |
| *B05B 12/12* | (2006.01) |

(52) U.S. Cl.
CPC ..... *B05B 7/0018* (2013.01); *B05B 7/267* (2013.01); *B05B 12/122* (2013.01)

(56) References Cited

U.S. PATENT DOCUMENTS

| | | | | |
|---|---|---|---|---|
| 2007/0241137 | A1* | 10/2007 | Willis | A47K 5/14 222/190 |
| 2012/0234947 | A1* | 9/2012 | Takahashi | B05B 1/02 239/601 |
| 2013/0134237 | A1 | 5/2013 | Damet | |
| 2016/0302624 | A1 | 10/2016 | Little | |

FOREIGN PATENT DOCUMENTS

| | | | |
|---|---|---|---|
| JP | 2006-346611 | A | 12/2006 |
| JP | 3159292 | U | 5/2010 |
| JP | 2010-149060 | A | 7/2010 |
| JP | 2010-269233 | A | 12/2010 |
| JP | 2011-31889 | A | 2/2011 |
| JP | 3169573 | U | 8/2011 |
| JP | 2013-212244 | A | 10/2013 |
| JP | 2014-569 | A | 1/2014 |
| JP | 2016-108050 | A | 6/2016 |
| JP | 2016-209867 | A | 12/2016 |
| WO | WO 2015/082918 | A1 | 6/2015 |
| WO | WO-2015082918 | A1 * | 6/2015 |

OTHER PUBLICATIONS

Extended European Search Report dated Dec. 12, 2018 in corresponding European Patent Application No. 16817739.2, 10 pages.

* cited by examiner

BUBBLE DISCHARGING NOZZLE AND BUBBLE DISCHARGING DEVICE

CROSS REFERENCE TO RELATED APPLICATION

This application is a national phase application of PCT/JP2016/067883, filed Jun. 16, 2016, the entire content and disclosure of which is incorporated into the present application.

TECHNICAL FIELD

The present invention relates to a foam discharging nozzle and a foam discharging device provided therewith.

BACKGROUND ART

A foam discharging device that mixes liquid soap with a gas to discharge the soap as a mousse-like foam is known (Patent Literature 1).

Also, techniques have been proposed to discharge foam such that the discharge foam has a specific shape. For example, Patent Literature 2 proposes a technique for forming, with a single pressing operation, a foam-formed product that looks like a character by attaching a foam discharging adapter having a plurality of discharging openings formed according to a specific arrangement and diameter to a nozzle head of a foam pump-equipped container that discharges content liquid as foam from a nozzle by pressing and operating the nozzle head. Patent Literature 3 proposes a similar foam discharging adapter, whereby a twisted foam-formed product is formed by a single pressing operation.

CITATION LIST

Patent Literature

Patent Literature 1: JP 2013-212244A
Patent Literature 2: JP 2010-149060A
Patent Literature 3: JP 2010-269233A

SUMMARY OF INVENTION

The invention relates to a foam discharging nozzle for a foam discharging device, including: a foam diffusion space to which foam produced by mixing a liquid and a gas is supplied from a foam supply opening located on an upper side; and at least one or a plurality of foam discharging openings formed in a bottom portion of the foam diffusion space. An area of the bottom portion of the foam diffusion space is wider than an area of the foam supply opening. A centroid of the foam discharging opening does not match a centroid of a supply opening projected portion formed by projecting the foam supply opening onto the bottom portion parallel to a central axis of the foam diffusion space.

The invention relates to a foam discharging nozzle for a foam discharging device, including: a foam diffusion space to which foam produced by mixing a liquid and a gas is supplied from a foam supply opening located on an upper side; and at least one or a plurality of foam discharging openings formed in a bottom portion of the foam diffusion space. An area of the bottom portion of the foam diffusion space is wider than an area of the foam supply opening. The foam discharging opening does not overlap a supply opening projected portion formed by projecting the foam supply opening onto the bottom portion parallel to a central axis of the foam diffusion space.

The invention provides a foam discharging device including the aforementioned foam discharging nozzle.

DESCRIPTION OF EMBODIMENTS

According to the technique of Patent Literature 1, even if an attempt is made to discharge foam that has been shaped, it is difficult to form the foam into a desired shape. According to the technique proposed in Patent Literature 2, it is difficult to adjust the discharge amount and the flow of foam to the plurality of discharging openings, and thus, depending on the shape of the formed product, it is difficult to form the foam-formed product into a desired shape. The technique of Patent Literature 3 is difficult to apply to shapes other than a twisted three-dimensional shape.

The invention relates to a foam discharging nozzle and a foam discharging device capable of stably forming a foam-formed product into a desired shape.

The invention is described below according to preferred embodiments.

Figure 1:
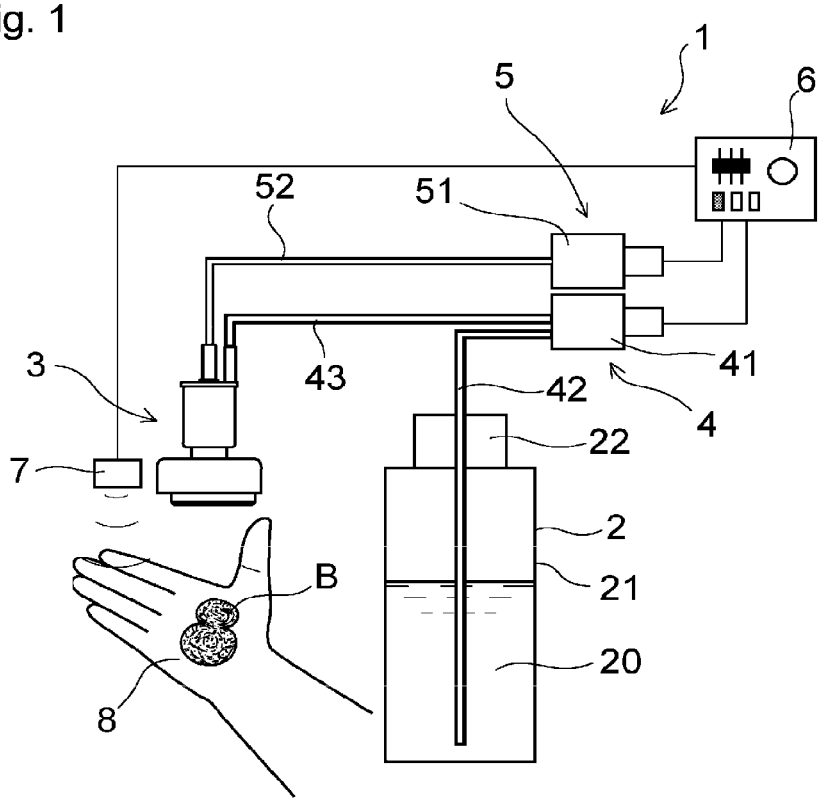
FIG. 1 is a schematic diagram illustrating a schematic configuration of an embodiment of a foam discharging device of the invention.

FIG. 1 illustrates a schematic configuration of a foam discharging device 1, which is an embodiment of a foam discharging device according to the invention. The foam discharging device 1 is a foam discharging device provided with a foam discharging nozzle 3, which is an embodiment of a foam discharging nozzle according to the invention, and can discharge, from the foam discharging nozzle 3, foam produced by mixing a liquid 20 with a gas. In the present embodiment, the liquid 20 is liquid soap, and the gas is air.

With the foam discharging device 1 of the present embodiment, a fixed amount of foam is discharged by placing a foam receiver 8, such as a person's hand or a sponge, below the foam discharging nozzle 3, and a foam-formed product B can be stably formed into a desired shape on the foam receiver 8. FIG. 1 illustrates an example of discharging foam onto the palm of a person's hand, which is the foam receiver 8, and forming a foam-formed product B having a snowman-shaped contour on the palm. In cases where a person's hand is the foam receiver 8, foam can be discharged onto the back of the hand.

The foam receiver 8 is an article, or a portion of the body, that receives the foam discharged from the foam discharging nozzle 3, and may be a person's hand or a sponge as described above, or a dustcloth, a cleaning sheet, the top of a table, etc.

More specifically, the foam discharging device 1 of the present embodiment is an electric-motor-type foam discharging device, and includes: a storage 2 for the liquid 20; the foam discharging nozzle 3; a liquid supply mechanism 4 for supplying the liquid 20 in the storage 2 to the foam discharging nozzle 3; a gas supply mechanism 5 for taking in ambient air (gas) and supplying it to the foam discharging nozzle 3; and a control unit 6 for automatically driving the liquid supply mechanism 4 and the gas supply mechanism 5 for a given time when a predetermined signal is input. The foam discharging device 1 of the present embodiment includes a non-contact sensor 7 for detecting that a foam receiver 8, such as a person's hand or a sponge, has been placed below the foam discharging nozzle 3. Upon input of a detection signal issued when the sensor 7 has detected the foam receiver 8, the control unit 6 automatically drives the liquid supply mechanism 4 and the gas supply mechanism 5 for a given time.

The storage 2 is a container including a container body 21, and a cap 22 capable of hermetically closing an upper-end opening of the container body 21. The liquid supply mechanism 4 includes a liquid pump 41 provided with an electric motor, a first connection tube 42, and a second connection tube 43. While the liquid pump 41 is operating under control of the control unit 6, the liquid supply mechanism 4 sucks up the liquid 20 from inside the storage 2 and supplies the sucked-up liquid 20 to the foam discharging nozzle 3. For the liquid pump 41, it is possible to preferably use, for example, a centrifugal pump such as a volute pump, or a positive-displacement pump such as a syringe pump, a gear pump, a diaphragm pump, or a piezo pump. The gas supply mechanism 5 includes an air pump 51 provided with an electric motor, and an air feed tube 52. While the air pump 51 is operating under control of the control unit 6, the gas supply mechanism 5 sucks in outside air from a suction hole (not illustrated) and supplies the sucked-in air to the foam discharging nozzle 3. For the air pump 51, it is possible to preferably use, for example, a centrifugal pump such as a volute pump, or a positive-displacement pump such as a syringe pump, a gear pump, a diaphragm pump, or a piezo pump. For the first connection tube 42, the second connection tube 43, and the air feed tube 52, a rubber or synthetic resin-made tube or a metal pipe may be used, for example. It is preferable that the first connection tube 42, the second connection tube 43, and the air feed tube 52 are flexible.

The control unit 6 includes a computation processing unit, a storage unit, and a power source unit, and is electrically connected to the electric motor of the liquid pump 41, the electric motor of the air pump 51, and the sensor 7. The computation processing unit includes a microprocessor such as a CPU or MPU. The storage unit includes a ROM and/or a RAM and stores various programs and data for making the computation processing unit execute predetermined processes. Upon receiving a signal by the sensor 7 detected when a foam receiver 8, such as a person's hand or a sponge, has been placed below the foam discharging nozzle 3, the control unit 6 performs control so as to start driving the respective electric motors of the liquid pump 41 and the air pump 51. The power source unit supplies power to the electric motors of the liquid pump 41 and the air pump 51, the control unit, etc. The power source unit is constituted by, for example, a housing box for dry batteries, a secondary battery, or a built-in or external AC/DC converter. For the sensor 7, it is possible to use, for example, one of various types of sensors known as human/motion sensors, such as a pyroelectric sensor or a sensor consisting of an infrared-emitting diode and an infrared-receiving diode.

Figure 2:
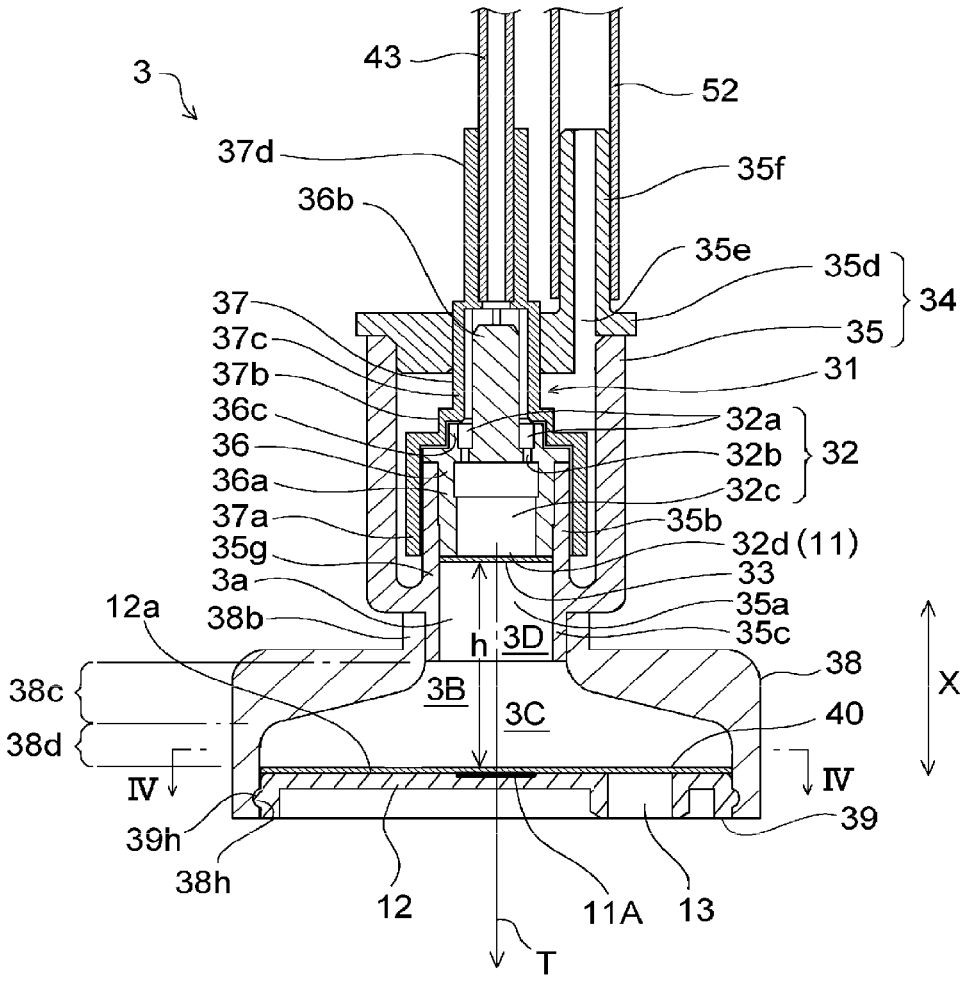
FIG. 2 is a longitudinal sectional view of a foam discharging nozzle of the foam discharging device illustrated in FIG. 1.

As illustrated in FIG. 2, the foam discharging nozzle 3 in the foam discharging device 1 includes a foam generating mechanism 31 including: a gas-liquid mixing portion 32 in which a liquid and a gas are mixed; and a first porous element 33 arranged downstream of the gas-liquid mixing portion 32. The gas-liquid mixing portion 32 includes a merging portion 32*a*, communication paths 32*b*, and a mixing chamber 32*c*. The foam discharging nozzle 3 in the foam discharging device 1 is constituted by various members illustrated in FIG. 3.

The foam discharging nozzle 3 includes a foamer case 34 including: a cylindrical case body 35; and a cap 35*d* hermetically attached to an upper-end opening of the case body. A vertically-penetrating through hole 35*a* is provided in the center of the bottom portion of the foamer case 34, more specifically, the center of the bottom portion of the case body 35. An upwardly-protruding cylindrical support portion 35*b* and a downwardly-protruding connection cylinder portion 35*c* are formed in the peripheral portion surrounding the through hole 35*a* in the bottom portion of the foamer case 34.

The foam generating mechanism 31 in the foam discharging device 1 of the present embodiment includes a foamer member 36 and a cylindrical joint member 37. The gas-liquid mixing portion 32 is formed by the foamer member 36 and the joint member 37. The merging portion 32*a* of the gas-liquid mixing portion 32 is formed within an annular depression between a guide rod portion 36*b* of the foamer member 36 and a protruding portion 36*c* arranged around the periphery of the lower portion of the guide rod portion. The communication path 32*b* is formed of a through hole from the annular depression to the mixing chamber 32*c*.

The foamer member 36 also has a circular-cylindrical portion 36*a* that is fitted into an upper-end portion of the cylindrical support portion 35*b* of the foamer case 34. The mixing chamber 32*c* of the gas-liquid mixing portion 32 is formed inside the circular-cylindrical portion 36*a* of the foamer member 36. Stated differently, the inner side of the circular-cylindrical portion 36*a* constitutes the mixing chamber 32*c* in which the content liquid and air are mixed. Note that, in the foamer member 36, the guide rod portion 36*b* used for positioning protrudes upward in a state where it is supported by an inner peripheral surface of an upper-end portion of the circular-cylindrical portion 36*a*.

The joint member 37 includes a large-diameter cylindrical portion 37*a*, a small-diameter cylindrical portion 37*c*, and a connection cylinder portion 37*d*. The large-diameter cylindrical portion 37*a* has an inner diameter similar to the outer diameter of the cylindrical support portion 35*b* of the foamer case 34. The small-diameter cylindrical portion 37*c* is provided continuously above the large-diameter cylindrical portion 37*a* via a step portion 37*b*. The connection cylinder portion 37*d* is provided continuously above the small-diameter cylindrical portion 37*c* via a step portion. The joint member 37 is attached to the cylindrical support portion 35*b* by fitting the large-diameter cylindrical portion 37*a* onto the upper-end portion of the cylindrical support portion 35*b* with the guide rod portion 36*b* of the foamer member 36 being inserted in the small-diameter cylindrical portion 37*c*. The guide rod portion 36*b* of the foamer member 36 is inserted and arranged inside the small-diameter cylindrical portion 37*c* of the joint member 37, thereby facilitating positioning between the foamer member 36 and the joint member 37.

The joint member 37 is retained by the case body 35 in a state where the small-diameter cylindrical portion 37*c* vertically penetrates the cap 35*d*. The second connection tube 43 of the liquid supply mechanism 4 is connected to the connection cylinder portion 37*d* provided continuously above the small-diameter cylindrical portion 37*c*. More specifically, the outer peripheral surface of the second connection tube 43 is in tight contact with the inner peripheral surface of the connection cylinder portion 37*d*. The inner peripheral surface of the small-diameter cylindrical portion 37*c* has a plurality of liquid flow grooves formed so as to extend linearly in the longitudinal direction. The liquid supplied by the liquid supply mechanism 4 is transferred to the merging portion 32*a* via the liquid flow grooves in the inner peripheral surface of the small-diameter cylindrical portion 37*c*, and merges with the gas at the merging portion 32*a*.

The cap 35*d* also has: a vertically-penetrating through hole 35*e*; and a connection cylinder portion 35*f* formed so as to extend upward from the periphery of the through hole 35*e*. The air feed tube 52 of the gas supply mechanism 5 is connected to the connection cylinder portion 35*f*. More specifically, the inner peripheral surface of the air feed tube 52 is connected to the outer peripheral surface of the connection cylinder portion 35*f*. Further, the inner peripheral surface of the large-diameter cylindrical portion 37*a* has gas flow grooves formed so as to extend linearly in the longitudinal direction. Air supplied by the gas supply mechanism 5 flows into a space between the inner peripheral surface of the foamer case 34 and the outer peripheral surface of the joint member 37, enters the gas flow grooves from the lower-end side of the joint member 37, flows through the gas flow grooves, and reaches the merging portion 32*a*. Note that a plurality of gas flow grooves are formed also in the inner surface of the ceiling portion of the joint member 37's large-diameter cylindrical portion 37*a* so as to extend in the horizontal direction, and a plurality of gas flow grooves are also formed in the inner surface of the step portion 37*b* so as to extend in the vertical direction.

In the foamer member 36, the cylindrical protruding portion 36*c* is formed so as to protrude upward around the periphery of the lower portion of the guide rod portion 36*b*. The protruding portion 36*c* is formed with a constant spacing between it and the outer peripheral surface of the guide rod portion 36*b*, thereby forming the annular depression between the guide rod portion 36*b* and the protruding portion 36*c*. The interior of this annular depression functions as the aforementioned merging portion 32*a*. A plurality of vertically-penetrating through holes are formed at predetermined intervals in the bottom portion of the aforementioned depression. These through holes function as the aforementioned communication paths 32*b*. The aforementioned gas flow grooves also extend in the inner peripheral surface of the joint member 37 opposing the cylindrical protruding portion 36*c*; air that has entered the gas flow grooves from the lower-end side of the joint member 37 passes through the gas flow grooves and reaches the upper-end position of the cylindrical protruding portion 36*c*, and from there, the air is injected to the aforementioned merging portion 32*a*.

The liquid that has merged with the gas at the merging portion 32*a* is mixed with the gas while it flows through the device 1's gas-liquid mixing portion 32—i.e., the merging portion 32*a*, the communication path 32*b*, and the mixing chamber 32*c*—and made into coarse bubbles; then, by passing through the first porous element 33 arranged on a lower-end opening of the foamer member 36's circular-cylindrical portion 36*a*, which is the outlet of the gas-liquid mixing portion 32, the bubbles are made into foam consisting of an assembly of minuscule bubbles, which is then sent out from the lower surface of the first porous element 33 to a foam discharging path 3*a*. For the first porous element 33, it is possible to use, for example, a synthetic resin-made or metal-made mesh sheet, a sintered compact of metal particles, or a spongy molded product made of a synthetic resin having a three-dimensional meshed structure. The first porous element 33 can be fixed according to one of various known methods, such as heat sealing, ultrasonic sealing, an adhesive, or fitting to the lower-end portion of the circular-cylindrical portion 36*a*.

As illustrated in FIG. 2, the foam discharging nozzle 3 of the present device 1 includes a foam diffusion space 3B below the first porous element 33. A lower-end opening 32*d* of the foamer member 36's circular-cylindrical portion 36*a*, which is the outlet of the aforementioned gas-liquid mixing portion 32, constitutes a foam supply opening 11 for supplying foam to the foam diffusion space 3B. More specifically, the lower-end opening 32*d*, which is covered by the first porous element 33, is the foam supply opening 11 in the present embodiment. The foam supply opening 11 is located on the upper side of the foam diffusion space 3B, and the foam produced by mixing the liquid 20 with gas passes through the foam supply opening 11 and is supplied into the foam diffusion space 3B. The foam diffusion space 3B is a space for diffusing the foam supplied to the foam diffusion space 3B in a direction intersecting with the direction T in which the foam is discharged. The foam supplied to the foam diffusion space 3B moves downward inside the foam diffusion space 3B and is also diffused in the horizontal direction, and is then discharged downward from foam discharging opening 13 formed in the bottom portion 12 of the foam diffusion space 3B. In relation to the device 1 of the present embodiment and constituent elements thereof, the "upper side" and "upward/above" refer to the upper side and upward direction in the vertical direction when the device 1 is in use, and "lower side" and "downward/below" refer to the lower side and downward direction in the vertical direction when the device 1 is in use. The bottom portion 12 of the foam diffusion space 3B is formed in a location opposing the foam supply opening 11. The area of the bottom portion 12 of the foam diffusion space 3B is wider than the area of the foam supply opening 11. The area of the bottom portion 12 of the foam diffusion space 3B is the area, in a planar view, of the upper surface facing the foam diffusion space 3B, and includes the area of foam discharging opening(s) 13. The foam supply opening 11 is provided with the first porous element 33; however, the area of the foam supply opening 11 is the area of the lower-end opening of the circular-cylindrical portion 36*a* of the foamer member 36, and is also equivalent to the area of the outlet 32*d* of the gas-liquid mixing portion 32.

As illustrated in FIG. 2, the foam diffusion space 3B of the present device 1 includes: a lower space 3C formed inside a horizontal diffusion promoting member 38 coupled to the lower side of the foamer case 34; and an upper space 3D located between the first porous element 33 and the lower space 3C. The upper space 3D is a section located below the first porous element 33 in a hollow portion formed inside a cylindrical element 35*g* forming the through hole 35*a* in the bottom portion of the foamer case 34. The cylindrical element 35*g* in the present device 1 is formed by the aforementioned cylindrical support portion 35*b*, the through hole 35*a*, and the connection cylinder portion 35*c*. On the other hand, the lower space 3C is a section located below the connection cylinder portion 35*c* in a hollow portion formed inside the horizontal diffusion promoting member 38. The cross-sectional area at a plane orthogonal to the foam discharge direction T of each of the lower space 3C and the upper space 3D is larger than the area of the foam supply opening 11 over the entire range in the height direction of the foam discharging nozzle 3. The horizontal cross-sectional shape of the inner peripheral surface of the foam diffusion space 3B in the device 1 of the present embodiment is circular, and the planar-view shape of the bottom portion 12 is also circular. In the device 1 of the present embodiment, the centroid 11*c* of a supply opening projected portion 11A overlaps the center of the foam diffusion space 3B having a circular horizontal cross-sectional shape.

The horizontal diffusion promoting member 38 has an outer peripheral surface with a greater diameter than the outer peripheral surface of the foamer case 34, and has a hollow portion penetrating the horizontal diffusion promoting member 38 in the vertical direction. The upper end portion of the horizontal diffusion promoting member 38 includes a connection cylinder portion 38*b* protruding so as to surround the hollow portion. The horizontal diffusion promoting member 38 is connected to the lower side of the foamer case 34 by fitting the connection cylinder portion 35*c* of the foamer case 34 to the inside of the connection cylinder portion 38*b*. The lower space 3C formed inside the horizontal diffusion promoting member 38 has an inner peripheral surface with a larger inner diameter at the lower end than at the upper end, and the cross-sectional area at a plane orthogonal to the foam discharge direction T enlarges from above toward below. A discharging opening formation member 39 is fitted and fixed to the lower-end portion of the hollow portion of the horizontal diffusion promoting member 38. The lower space 3C in the present embodiment includes: a cross-sectional-area enlarging portion 38*c* wherein the cross-sectional area at a plane orthogonal to the foam discharge direction T gradually increases from above toward below; and a cross-sectional-area non-changing portion 38*d* wherein the cross-sectional area at a plane orthogonal to the foam discharge direction T is constant in the vertical direction. In the present embodiment, the upper space 3D's cross-sectional area at a plane orthogonal to the foam discharge direction T is also constant in the vertical direction.

It should be noted that the cross-sectional shape of the foam diffusion space 3B and the shape of the foamer case 34 and the horizontal diffusion promoting member 38 for forming the foam diffusion space 3B are not limited to the shapes of the present embodiment, and can be designed discretionarily with consideration given to the design of the foam discharging device 1, the foam discharge amount, etc. For example, the upper space 3D's cross-sectional area at a plane orthogonal to the foam discharge direction T may be enlarged gradually from above toward below, and the lower space 3C may not have the cross-sectional-area non-changing portion 38*d*. Alternatively, the outer side of the cross-sectional-area enlarging portion 38*c* of the horizontal diffusion promoting member 38 may be shaped so as to be gradually enlarged like the shape of the hollow portion.

The discharging opening formation member 39 is fitted and fixed to the lower-end portion of the horizontal diffusion promoting member 38.

In the present embodiment, the foam diffusion space 3B is a space from the lower surface of the first porous element 33, which is arranged at the outlet of the gas-liquid mixing portion 32, to the upper surface of the discharging opening formation member 39, and is a section where the cross-sectional area at a plane orthogonal to the foam discharge direction T is larger than the area of the foam supply opening 11. The foam discharge direction T is a direction parallel to the central axis of the foam diffusion space 3B.

For example, in cases where the foam diffusion space 3B has the shape of a body of revolution, such as circular columnar or circular conical, the direction parallel to the central axis of the foam diffusion space 3B—i.e., the foam discharge direction T—is the direction parallel to the rotation axis of the body of revolution, and in cases where the foam diffusion space 3B has a prismatic shape, the foam discharge direction is the direction parallel to the central axis of the prism. If the direction in which the central axis of the foam diffusion space 3B extends cannot be determined unambiguously, the direction parallel to the central axis of the foam diffusion space 3B (i.e., the foam discharge direction T) is a direction perpendicular to the upper surface of the bottom portion 12 of the foam diffusion space 3B. Preferably, the foam discharging device 1 is used in a state where the foam discharge direction T of the foam discharging nozzle 3 matches the vertical direction X. FIG. 2 illustrates a longitudinal sectional view by a plane including the central axis of the foam diffusion space 3B.

In the present embodiment, the direction in which the foam is discharged from the outlet 32*d* of the gas-liquid mixing portion 32 toward the foam diffusion space 3B is also in the foam discharge direction T, and preferably matches the vertical direction X. Further, in the foam discharging nozzle 3 of the present embodiment, the direction from above toward below, which is the direction in which the liquid 20 and foam travel, is in the vertical direction. The expression "matches the vertical direction" encompasses both cases where the foam discharge direction T is parallel to the vertical direction and cases where the foam discharge direction T is inclined with respect to the vertical direction but the inclination angle is within 5°.

Figure 3:
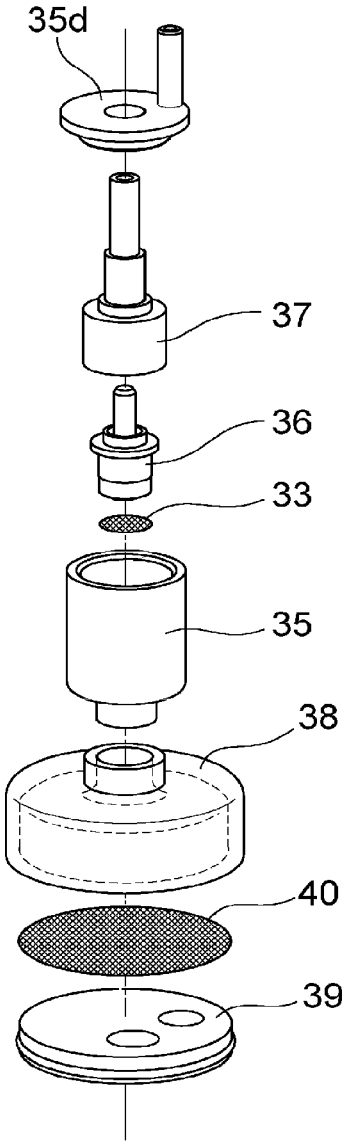
FIG. 3 is an exploded perspective view of the foam discharging nozzle of the foam discharging device illustrated in FIG. 1.

Note that, as illustrated in FIG. 3, the central axes of the respective constituent members of the foam discharging nozzle 3 of the present embodiment match one another.

The area of the foam diffusion space 3B's bottom portion 12, as well as the maximum value of the foam diffusion space 3B's cross-sectional area at a plane orthogonal to the foam discharge direction T, is preferably at least twice the area of the foam supply opening 11, and more preferably at least 10 times, even more preferably at least 50 times the area of the foam supply opening, and preferably at most 1000 times, more preferably at most 200 times, even more preferably at most 100 times the area of the foam supply opening, and preferably from 2 to 1000 times, more preferably from 10 to 200 times, even more preferably from 50 to 100 times the area of the foam supply opening.

The area of the foam diffusion space 3B's bottom portion 12, as well as the maximum value of the foam diffusion space 3B's cross-sectional area at a plane orthogonal to the foam discharge direction T, is preferably 0.5 $cm^2$ or greater, more preferably 2.8 $cm^2$ or greater, and preferably 300 $cm^2$ or less, more preferably 30 $cm^2$ or less.

The maximum value of the foam diffusion space 3B's cross-sectional area is the cross-sectional area at a location where the foam diffusion space 3B's cross-sectional area at a plane orthogonal to the foam discharge direction T becomes the greatest, and is the cross-sectional area at the cross-sectional-area non-changing portion 38*d* in the foam discharging nozzle 3 of the present embodiment. It is preferable that the foam diffusion space 3B has the location where the cross-sectional area becomes the greatest in a location adjacent to the foam discharging openings 13 or immediately above a second porous element 40.

The discharging opening formation member 39 is a member that forms, in the foam discharging nozzle 3, foam discharging openings 13 each having a predetermined shape. The discharging opening formation member 39 forms, for example, the plurality of foam discharging openings 13 shaped and arranged as illustrated in FIG. 4 in the bottom portion 12 of the foam diffusion space 3B.

The foam discharging openings 13 penetrate the discharging opening formation member 39, which forms the bottom portion 12 of the foam diffusion space 3B, in the thickness direction. Preferably, the shape and arrangement of each foam discharging opening 13 are the same over the entire range in the thickness direction of the discharging opening formation member 39. In cases where the shape and arrangement of the foam discharging opening 13 change, the shape and arrangement of the foam discharging opening 13 on the bottom portion 12's surface 12*a* on the foam diffusion space 3B side are considered the shape and arrangement of that foam discharging opening 13. From the viewpoint of diffusing the foam along the bottom portion 12, it is preferable that the foam diffusion space 3B has a flat surface facing the foam diffusion space 3B side around each foam discharging opening 13. Preferably, the upper surface 12*a* of the bottom portion 12 of the foam diffusion space 3B extends in a direction orthogonal to the foam discharge direction T, and preferably has an annular continuous flat surface 14 surrounding each foam discharging opening 13, as in the present embodiment.

Figure 4A:
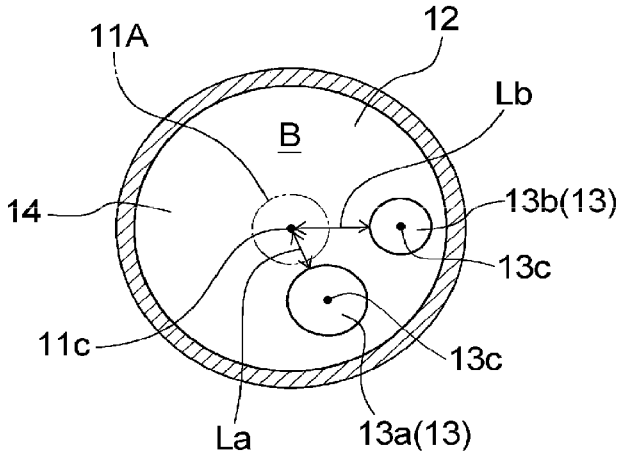
FIG. 4(*a*) is a diagram illustrating an example of foam discharging openings formed in a bottom portion of a foam diffusion space and is a cross-sectional view taken along line IV-IV in FIG. 2 with a second porous element omitted, and FIG. 4(*b*) is a plan view illustrating a planar-view shape of a foam-formed product obtained by the foam discharging openings shaped and arranged as illustrated in FIG. 4(*a*).
Figure 4B:
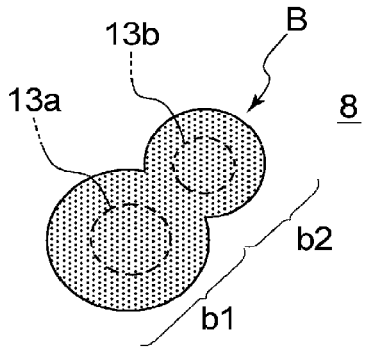

As illustrated in FIG. 4(*a*), in the foam discharging nozzle 3 employed in the foam discharging device 1 of the present embodiment, two foam discharging openings 13*a*, 13*b* separated from one another are formed as foam discharging openings 13 in the bottom portion 12 of the foam diffusion space 3B. The centroid 13*c* of each of the two foam discharging openings 13*a*, 13*b* does not overlap the centroid 11*c* of a supply opening projected portion 11A formed by projecting the aforementioned foam supply opening 11 onto the foam diffusion space 3B's bottom portion 12 parallel to the central axis of the foam diffusion space 3B. Further, the centroid 13*c* of each of the two foam discharging openings 13*a*, 13*b* does not overlap the supply opening projected portion 11A, as illustrated in FIG. 4(*a*).

In cases where there are a plurality of foam discharging openings separated from one another, the "centroid of the foam discharging opening" refers to the centroid of each foam discharging opening. The centroid is found from the shape of each foam discharging opening in a planar view of the bottom portion of the foam diffusion space. As illustrated in FIG. 4, when the shape of the foam discharging opening is circular, the center of the circle is the centroid. The centroid of a non-circle can be found easily with a commercially-available CAD or graphic drawing software.

In the foam discharging device 1 of the present embodiment, as illustrated in FIG. 4(*a*), neither of the foam discharging openings 13*a*, 13*b* formed in the bottom portion 12 of the foam diffusion space 3B overlap the supply opening projected portion 11A.

The supply opening projected portion 11A is a section formed by projecting the opening shape of the foam supply opening 11 onto the bottom portion 12 parallel to the central axis of the foam diffusion space 3B, and is the region within the circle depicted by the dot-and-dash line as illustrated in FIG. 4(*a*). In the present embodiment, the aforementioned foam discharge direction T, the direction parallel to the central axis of the foam diffusion space 3B, and the vertical direction X are all parallel, and the diameter and area of the supply opening projected portion 11A are the same as the diameter and opening area of the foam supply opening 11, i.e., the lower-end opening 32*d* of the circular-cylindrical portion 36*a* of the foamer member 36. If the foam discharging opening 13 and the supply opening projected portion 11A overlap only at their respective peripheral edges, it is considered that the foam discharging opening 13 and the supply opening projected portion 11A do not overlap one another.

According to the foam discharging device 1 of the present embodiment, when a foam receiver 8, such as a person's hand or a sponge, is placed below the foam discharging nozzle 3, the sensor 7 detects this and sends a detection signal to the control unit 6. Upon receiving the signal from the sensor 7, the control unit 6 drives the liquid supply mechanism 4 and the gas supply mechanism 5 for a given time. Thus, a fixed amount of liquid is supplied to the foam discharging nozzle 3 by the liquid supply mechanism 4, and a fixed amount of air is supplied to the foam discharging nozzle 3 by the gas supply mechanism 5, and thereby, a fixed amount of foam is discharged from the foam discharging openings of the foam discharging nozzle 3 onto the foam receiver 8, such as a person's hand or a sponge.

According to the foam discharging device 1 of the present embodiment, foam produced by mixing the liquid 20 and a gas is supplied from the foam supply opening 11 into the foam diffusion space 3B, and the foam moves downward inside the foam diffusion space 3B. Since the plurality of foam discharging openings 13*a*, 13*b* are arranged such that their respective centroids 13*c* do not overlap the centroid 11*c* of the supply opening projected portion 11A, a portion of the foam impinges upon a section other than the foam discharging openings 13 and is diffused in the horizontal direction along the bottom portion 12. Then, the foam supplied in the foam diffusion space 3B is discharged from each section of the plurality of foam discharging openings 13*a*, 13*b* onto the foam receiver 8, such as a sponge or the palm of a hand, at an averaged-out speed.

Thus, by appropriately designing the shape and arrangement of the foam discharging openings 13, it is possible to stably form a foam-formed product B having a contour of a desired shape on, for example, the palm or back of a person's hand or on the surface of a sponge. Thus, enjoyment and freshness can be offered when, for example, washing the hands or face by applying soap or medicinal solution to the palm or back of the hand, or cleaning dishes, the bath, the kitchen, etc., by applying soap or medicinal solution to the surface of a sponge.

Further, in the present embodiment, since neither of the respective centroids 13*c* of the plurality of foam discharging openings 13*a*, 13*b* overlap the supply opening projected portion 11A itself, the foam is discharged onto the foam receiver 8 at an even further averaged-out speed, thereby further improving formability of the foam-formed product B having a predetermined planar-view shape.

Furthermore, since each of the foam discharging openings 13*a*, 13*b* is arranged so as not to overlap the supply opening projected portion 11A, the foam supplied into the foam diffusion space 3B is discharged from each section of the foam discharging openings 13*a*, 13*b* onto the foam receiver 8, such as the palm of a hand or a sponge, at an averaged-out speed more reliably. Thus, formability of the foam-formed product B having a predetermined planar-view shape is further improved.

FIG. 4(*b*) is a diagram illustrating a foam-formed product B having a snowman-like planar-view shape formed on the foam receiver 8 by the foam discharging openings 13 shaped and arranged as illustrated in FIG. 4(*a*).

The foam-formed product B having a snowman-like planar-view shape includes a large area portion b1 and a small area portion b2 that have different sizes from one another in a planar view. The large area portion b1 is formed by foam discharged mainly from the first discharging opening 13*a*, which is one of the two foam discharging openings 13*a*, 13*b*, and the small area portion b2 is formed by foam discharged mainly from the second discharging opening 13*b*, which is the other of the two foam discharging openings 13*a*, 13*b*.

As described above, in cases of forming a foam-formed product B including a large area portion b1 and a small area portion b2 that have different sizes from one another in a planar view, since foam is viscoelastic and a greater amount is likely to be discharged from the foam discharging opening located closer to the supply opening projected portion 11A, it is preferable that the distance La between the first discharging opening 13*a*—which discharges the foam mainly forming the large area portion b1—and the centroid 11*c* of the supply opening projected portion 11A is shorter than the distance Lb between the second discharging opening 13*b*—which discharges the foam mainly forming the small area portion b2—and the centroid 11*c* of the supply opening projected portion 11A, as illustrated in FIG. 4(*a*).

In this case, as regarding the first discharging opening 13*a* and the second discharging opening 13*b*, the area of the first discharging opening 13*a* may be larger than the area of the second discharging opening 13*b*, but the area of the first discharging opening 13*a* and the area of the second discharging opening 13*b* may be the same. In cases of making the area of the first discharging opening 13*a* the same as the area of the second discharging opening 13*b*, the distance is increased between the centroid 11*c* of the supply opening projected portion 11A and the discharging opening for forming the large area portion of the foam-formed product B.

Further, by increasing the difference between the distance Lb and the distance La—more specifically, by making the distance Lb even longer than the distance La and making the distance La even shorter than the distance Lb—the area of the first discharging opening 13*a* for discharging the foam forming the large area portion b1 can be made smaller than the area of the second discharging opening 13*b*.

Note that, as a method for forming the foam-formed product B including the large area portion b1 and the small area portion b2 that have different sizes from one another in a planar view, it is also possible to employ a method of simply making the area of the first discharging opening 13*a* for discharging the foam forming the large area portion b1 larger than the area of the second discharging opening 13*b* for discharging the foam forming the small area portion b2. Alternatively, the method of varying the area and the method of varying the distance can be employed in combination.

Figure 10A:
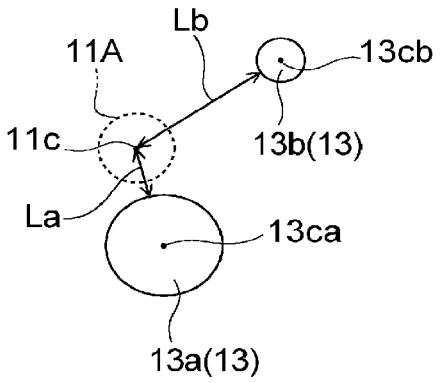
FIG. 10(*a*) is a plan view of a bottom portion of a foam diffusion space, illustrating yet another example of foam discharging openings formed in the bottom portion of the foam diffusion space, and FIG. 10(*b*) is a plan view illustrating a planar-view shape of a foam-formed product obtained by the foam discharging openings shaped and arranged as illustrated in FIG. 10(*a*).
Figure 10B:
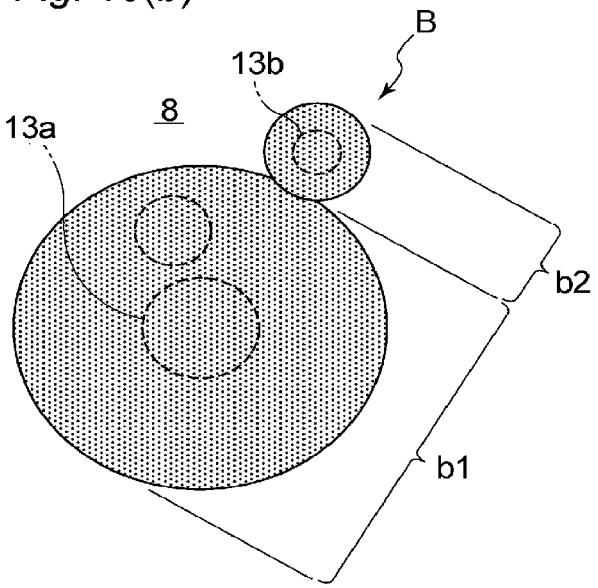

In cases of forming a foam-formed product B including a large area portion b1 and a small area portion b2 that have different sizes from one another in a planar view, since foam is viscoelastic and tends to flow in an easily-flowable direction and toward an outlet with less resistance, when the distance La between the first discharging opening 13*a*—which discharges the foam for forming the large area portion b1—and the centroid 11*c* of the supply opening projected portion 11A is shorter than the distance Lb between the second discharging opening 13*b*—which discharges the foam for forming the small area portion b2—and the centroid 11*c* of the supply opening projected portion 11A as illustrated in FIGS. 10(*a*) and 10(*b*), the ratio (Ga/Gb) of the area Ga of the large area portion b1 to the area Gb of the small area portion b2 becomes greater than the ratio (Sa/Sb) of the area Sa of the first discharging opening 13*a* to the area Sb of the second discharging opening 13*b*.

Figure 11A:
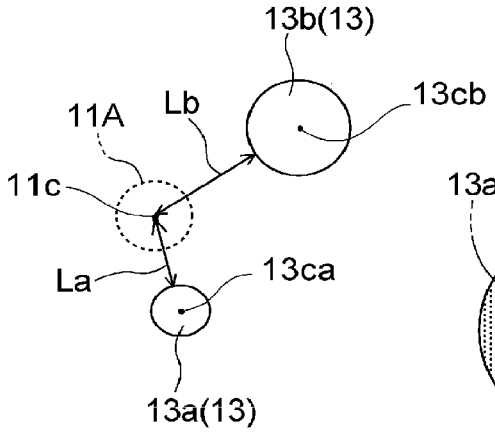
FIG. 11(*a*) is a plan view of a bottom portion of a foam diffusion space, illustrating yet another example of foam discharging openings formed in the bottom portion of the foam diffusion space, and FIG. 11(*b*) is a plan view illustrating a planar-view shape of a foam-formed product obtained by the foam discharging openings shaped and arranged as illustrated in FIG. 11(*a*).
Figure 11B:
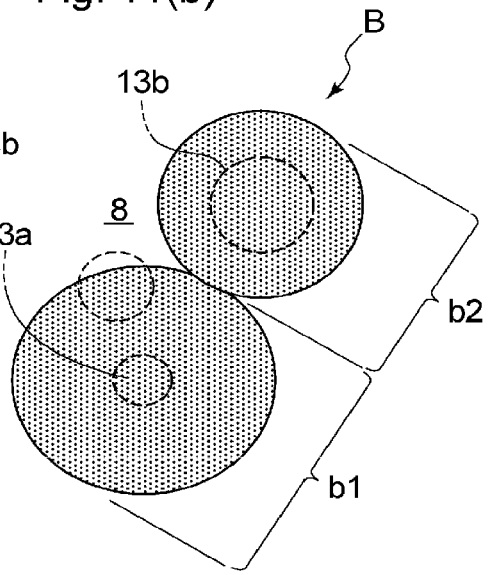

Likewise, since foam is viscoelastic and tends to flow in an easily-flowable direction and toward an outlet with less resistance, when, as illustrated in FIG. 11, the area Sa of the first discharging opening 13*a* is smaller than the area Sb of the second discharging opening 13*b* but the distance La between the first discharging opening 13*a* and the centroid 11*c* of the supply opening projected portion 11A is shorter than the distance Lb between the second discharging opening 13*b* and the centroid 11*c* of the supply opening projected portion 11A, the ratio (Ga/Gb) of the area Ga of the large area portion b1 to the area Gb of the small area portion b2 becomes greater than the ratio (Sa/Sb) of the area Sa of the first discharging opening 13*a* to the area Sb of the second discharging opening 13*b*. Thus, the first discharging opening 13*a* with the smaller area Sa discharges the foam for forming the large area portion b1.

From the viewpoint of efficiently forming a foam-formed product B having a desired planar-view shape by taking advantage of the aforementioned characteristics, it is preferable that the first discharging opening 13*a* for discharging the foam for forming the large area portion b1 and the second discharging opening 13*b* for discharging the foam for forming the small area portion b2 are formed so as to satisfy the following equation (1).

[Math. 1]

$$\frac{Gb}{Ga} = \alpha \times \frac{Sb \times La}{Sa \times Lb} \quad (1)$$

In the equation (1), Ga is the area of the large area portion, Gb is the area of the small area portion, Sa is the area of the first discharging opening 13*a*, La is the distance between the centroid 13*ca* of the first discharging opening 13*a* and the centroid 11*c* of the supply opening projected portion 11A, Sb is the area of the second discharging opening 13*b*, Lb is the distance between the centroid 13*cb* of the second discharging opening 13*b* and the centroid 11*c* of the supply opening projected portion 11A, and a is a real number from 0.1 to 2 inclusive.

Alpha (α) is a coefficient defined with consideration given to the flowability of foam, and changes depending on, for example, the liquid 20 being used and the foam generating mechanism 31. The coefficient a is found in advance from the foam formed by the liquid 20 being used, the foam generating mechanism 31, etc., as follows. First, a nozzle 3 is prepared, wherein a first discharging opening 13*a* and a second discharging opening 13*b* having an area Sb that is twice the area Sa of the first discharging opening 13*a* are arranged equidistantly from the centroid 11*c* of a supply opening projected portion 11A of a foam supply opening 11. Next, a foam-formed product B is discharged from the first discharging opening 13*a* and the second discharging opening 13*b*, and the area Ga of the large area portion b1 and the area Gb of the small area portion b2 are measured. The measurement results are assigned to the equation (1), to calculate α.

Figure 5A:
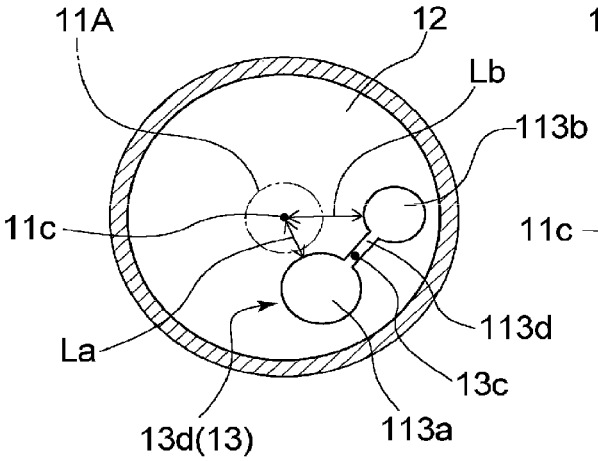
FIGS. 5(*a*) and 5(*b*) are diagrams (corresponding to FIG. 4(*a*)) illustrating other examples of a foam discharging opening formed in the bottom portion of the foam diffusion space.
Figure 5B:
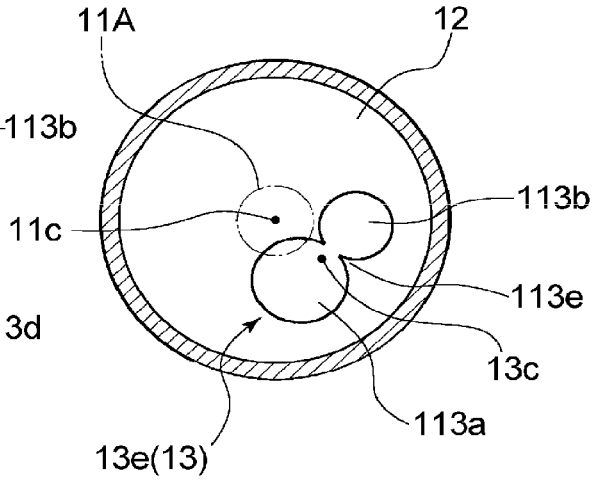

FIGS. 5(*a*) and 5(*b*) illustrate other examples of foam discharging openings 13 formed in the bottom portion 12 of the foam diffusion space 3B.

In the example illustrated in FIG. 5(*a*), a foam discharging opening 13*d* having a configuration in which a plurality of main discharging portions 113*a*, 113*b* are connected together via a slit-shaped narrow-width boundary discharging portion 113*d* is formed as the foam discharging opening 13 in the bottom portion 12 of the foam diffusion space 3B. Also in the example illustrated in FIG. 5(*a*), the centroid 13*c* of the foam discharging opening 13*d* does not overlap the centroid 11*c* of the supply opening projected portion 11A, and also, as illustrated in FIG. 5(*a*), the centroid 13*c* of the foam discharging opening 13*d* does not overlap the supply opening projected portion 11A. Further, in the example illustrated in FIG. 5(*a*), the foam discharging opening 13*d* does not overlap the supply opening projected portion 11A. Note that, as described above, if the foam discharging opening 13 and the supply opening projected portion 11A overlap only at their respective peripheral edges, it is considered that the foam discharging opening 13 and the supply opening projected portion 11A do not overlap one another.

The centroid 13*c* of the foam discharging opening 13*d* is the barycenter of a plate-like element which is assumed to be arranged at the position of the foam discharging opening 13, the plate-like element having a uniform density and the same shape and same size as the foam discharging opening 13.

The centroid 13*c* of the foam discharging opening 13*d* can also be found according to the following method.

The centroid 13*c* of the foam discharging opening 13*d* is not the centroid of each of the foam discharging openings 113*a*, 113*b*, but rather, found as follows.

Two axes orthogonal to one another are discretionarily defined on the plane where the foam discharging opening 13*d* is present. Assuming that (Ax, Ay), (Bx, By), and (Cx, Cy) respectively define the positions of the respective centroids of the foam discharging portions 113*a*, 113*b* and the boundary discharging portion 113*d* (same hereinbelow), SA, SB, and SC define the respective areas of the foam discharging portions 113*a*, 113*b* and the boundary discharging portion 113*d* (same hereinbelow), S-all defines the entire area of the foam discharging opening 13*d*, and (Mx, My) defines the coordinates of the centroid 13*c*, the centroid 13*c* of the foam discharging opening 13*d* refers to the coordinates (Mx, My) satisfying the moments (the following two equations) about the origin point O of the coordinate system.

$$SA \times Ax + SB \times Bx + SC \times Cx + \ldots = S\text{-all} \times Mx \quad \text{(Equation 1)}$$

$$SA \times Ay + SB \times By + SC \times CY + \ldots = S\text{-all} \times My \quad \text{(Equation 2)}$$

Note that the centroid 13*c* of the foam discharging opening 13*d* can also be found easily with a commercially-available CAD or graphic drawing software.

In the example illustrated in FIG. 5(*b*), a foam discharging opening 13*e* having a configuration in which a plurality of main discharging portions 113*a*, 113*b* are connected together via a narrow-width boundary discharging portion 113*e* is formed as the foam discharging opening 13 in the bottom portion 12 of the foam diffusion space 3B. Also in the example illustrated in FIG. 5(*b*), the centroid 13*c* of the foam discharging opening 13*e* does not overlap the centroid 11*c* of the supply opening projected portion 11A, and also, as illustrated in FIG. 5(*b*), the centroid 13*c* of the foam discharging opening 13*e* does not overlap the supply opening projected portion 11A. In the example illustrated in FIG. 5(*b*), a portion of the foam discharging opening 13*e* overlaps the supply opening projected portion 11A, but it is preferable to arrange the foam discharging opening 13*e* so as not to overlap the supply opening projected portion 11A.

The area of the portion where the foam discharging opening 13*e* and the supply opening projected portion 11A overlap one another is preferably from 0 to 30%, more preferably from 0 to 10%, with respect to the area of the foam discharging opening 13*e*.

The centroid 13*c* of the foam discharging opening 13*e* can be found in the same manner as in the centroid 13*c* of the aforementioned foam discharging opening 13*d*; however, since the boundary discharging portion 113*e* has no area, the centroid of the boundary discharging portion 113*e* is disregarded. The cross-sectional shape of the foam discharging opening 13*e* has a shape wherein circular main discharging portions 113*a*, 113*b* overlap one another, and the main discharging portions 113*a*, 113*b* are not completely circular; however, the position of the centroid is found assuming that they are circular. Note that the centroid 13*c* of the foam discharging opening 13*e* can also be found easily with a commercially-available CAD or graphic drawing software.

Even in cases where the foam discharging opening 13*d* or 13*e* shaped and arranged as illustrated in FIG. 5(*a*) or 5(*b*) is formed in the bottom portion 12 of the foam diffusion space 3B of the foam discharging nozzle 3 of the foam discharging device 1 according to the foregoing embodiment, the foam supplied in the foam diffusion space 3B can be discharged from each section of the foam discharging opening 13*d* or 13*e* onto a foam receiver 8, such as a sponge or the palm of a hand, at an averaged-out speed, and thus, it is possible to stably form a foam-formed product B with a desired contour on the foam receiver 8.

As in the examples illustrated in FIGS. 5(*a*) and 5(*b*), in cases where a narrow-width boundary discharging portion 113*d*, 113*e* is provided between the main discharging portions 113*a*, 113*b*, the width of the boundary discharging portion 113*d*, 113*e* is preferably from 0.1 to 5.0 mm, more preferably from 0.5 to 2.0 mm. As regards the slit-shaped boundary discharging portion 113*d*, the length, i.e., the width, in a direction orthogonal to the extending direction of the boundary discharging portion 113*d* is the width of the boundary discharging portion 113*d*.

Connecting the main discharging portions 113*a*, 113*b* with a narrow-width boundary discharging portion 113*d*, 113*e*—particularly with a slit-shaped boundary discharging portion 113*d*—is advantageous in terms of: reducing changes in positional relationship; formability of the contour of the adjoining section between the large area portion b1 and the small area portion b2; and suppressing formation of trailing thorns (i.e., peaks) when pulling the foam away.

Even in cases where the foam discharging opening 13*d* or 13*e* shaped and arranged as illustrated in FIG. 5(*a*) or 5(*b*) is formed, a foam-formed product B having a snowman-like planar-view shape, similar to the foam-formed product B illustrated in FIG. 4(*b*), can be formed on the foam receiver 8. In this case, the large area portion b1, which has a larger size in a planar view in the snowman-shaped foam-formed product B, is formed by foam discharged mainly from the first discharging portion 113*a*, which is one of the two main discharging portions 113*a*, 113*b*, and the small area portion b2 having a smaller size than the large area portion b1 in a planar view is formed by foam discharged mainly from the second discharging portion 113*b*, which is the other of the main discharging portions 113*a*, 113*b*.

As described above, in cases of forming a foam-formed product B including a large area portion b1 and a small area portion b2 that have different sizes from one another in a planar view, from the viewpoint that foam is viscoelastic and flows in an easily-flowable direction and toward an outlet with less resistance, it is preferable that the distance La between the first discharging portion 113*a*—which discharges the foam mainly forming the large area portion b1—and the centroid 11*c* of the supply opening projected portion 11A is shorter than the distance Lb between the second discharging portion 113*b*—which discharges the foam mainly forming the small area portion b2—and the centroid 11*c* of the supply opening projected portion 11A, as illustrated in FIG. 5(*a*). In this case, as regarding the first discharging portion 113*a* and the second discharging portion 113*b*, the area of the first discharging portion 113*a* may be larger than the area of the second discharging portion 113*b*, but the area of the first discharging portion 113*a* and the area of the second discharging portion 113*b* may be the same. Further, by increasing the difference between the distance Lb and the distance La, the area of the first discharging portion 113*a* can even be made smaller than the area of the second discharging portion 113*b*. Furthermore, as a method for forming the foam-formed product B including the large area portion b1 and the small area portion b2 that have different sizes from one another in a planar view, it is also possible to employ a method of simply making the area of the first discharging portion 113*a* for discharging the foam forming the large area portion b1 larger than the area of the second discharging portion 113*b* for discharging the foam forming the small area portion b2. Alternatively, the method of varying the area and the method of varying the distance can be employed in combination.

Further, as in the embodiment illustrated in FIG. 10, the ratio of the area of the first discharging portion 113*a* to the area of the second discharging portion 113*b* can be increased, and the distance La between the first discharging portion 113*a*—which discharges the foam mainly forming the large area portion b1—and the centroid 11*c* of the supply opening projected portion 11A can be made shorter than the distance Lb between the second discharging portion 113*b*—which discharges the foam mainly forming the small area portion b2—and the centroid 11*c* of the supply opening projected portion 11A.

Also in the examples illustrated in FIGS. 5(*a*) and 5(*b*), from the viewpoint of efficiently forming a foam-formed product B having a desired planar-view shape by taking advantage of the characteristics of foam, it is preferable that the first discharging portion 113*a* for discharging the foam for forming the large area portion b1 and the second discharging portion 113*b* for discharging the foam for forming the small area portion b2 are formed so as to satisfy the aforementioned equation (1). Herein, the discharge area of the boundary discharging portion 113*d*, 113*e* is small and can thus be disregarded in the aforementioned equation (1).

In the example illustrated in FIGS. 4(*a*) and 4(*b*) and in the examples illustrated in FIGS. 5(*a*) and 5(*b*), the foam-formed product B includes one large area portion and one small area portion. The invention, however, is not limited thereto, and may provide a foam-formed product B including a plurality of large area portions and a plurality of small area portions, or including a medium area portion in addition to a large area portion and a small area portion. In these cases, it is difficult to apply the various discharging openings or main discharging portions to the aforementioned equation (1), but as described above, from the viewpoint of easy flowability of foam, adjustment is made according to the method of varying the areas of the various discharging openings or main discharging portions, the method of varying the distances, or a combination thereof.

Figure 6A:
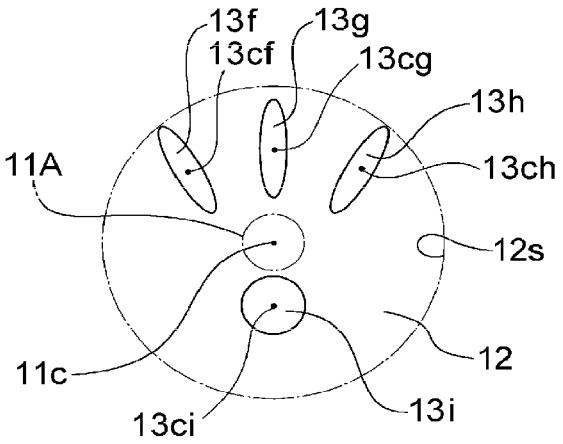
FIG. 6(*a*) is a plan view of a bottom portion of a foam diffusion space, illustrating another example of foam discharging openings formed in the bottom portion of the foam diffusion space, and FIG. 6(*b*) is a plan view illustrating a planar-view shape of a foam-formed product obtained by the foam discharging openings shaped and arranged as illustrated in FIG. 6(*a*).
Figure 6B:
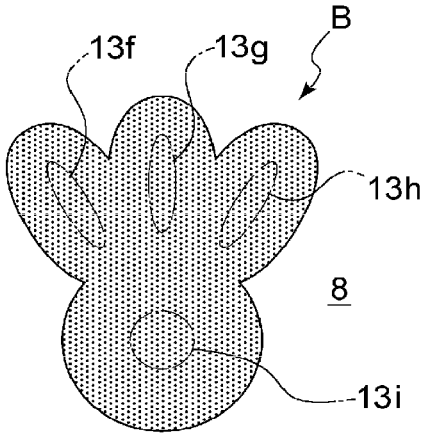

FIG. 6(*a*) illustrates another example of foam discharging openings formed in the bottom portion 12 of the foam diffusion space 3B. By forming foam discharging openings 13*f* to 13*i* shaped and arranged as illustrated in FIG. 6(*a*) in the bottom portion 12 of the foam diffusion space 3B of the foam discharging nozzle 3 of the foam discharging device 1 according to the foregoing embodiment, every time a fixed amount of foam is discharged by the foam discharging device 1 toward a foam receiver 8, a foam-formed product B having a planar-view shape of a shuttlecock used in Japanese badminton as illustrated in FIG. 6(*b*) can be formed on the foam receiver 8. Also in the example illustrated in FIG. 6(*a*), the respective centroids 13*cf* to 13*ci* of the foam discharging openings 13*f* to 13*i* neither overlap the centroid 11*c* of the supply opening projected portion 11A nor the supply opening projected portion HA itself, and moreover, none of the foam discharging openings 13*f* to 13*i* overlap the supply opening projected portion 11A.

Figure 7A:
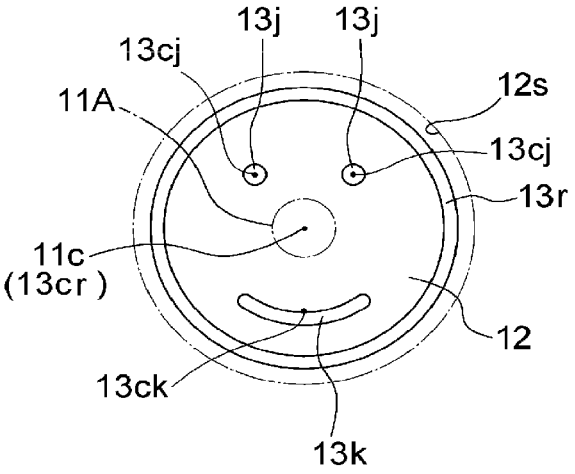
FIG. 7(*a*) is a plan view of a bottom portion of a foam diffusion space, illustrating yet another example of foam discharging openings formed in the bottom portion of the foam diffusion space, and FIG. 7(*b*) is a plan view illustrating a planar-view shape of a foam-formed product obtained by the foam discharging openings shaped and arranged as illustrated in FIG. 7(*a*).
Figure 7B:
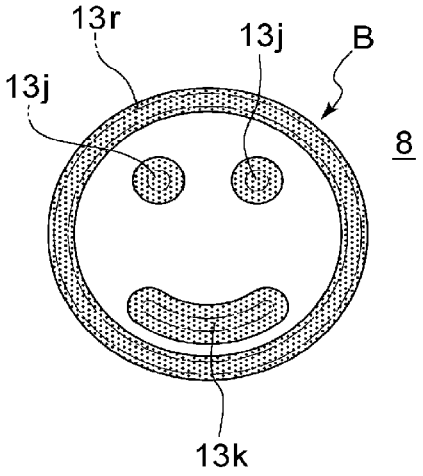

FIG. 7(*a*) illustrates yet another example of foam discharging openings formed in the bottom portion 12 of the foam diffusion space 3B. By forming foam discharging openings 13*j*, 13*k*, 13*r* shaped and arranged as illustrated in FIG. 7(*a*) in the bottom portion 12 of the foam diffusion space 3B of the foam discharging nozzle 3 of the foam discharging device 1 according to the foregoing embodiment, every time a fixed amount of foam is discharged by the foam discharging device 1 toward a foam receiver 8, a foam-formed product B having a planar-view shape like the face of an animal or person as illustrated in FIG. 7(*b*) can be formed on the foam receiver 8. In the example illustrated in FIG. 7(*a*), the respective centroids 13*cj*, 13*ck* of the non-annular foam discharging openings 13*j*, 13*k* neither overlap the centroid 11*c* of the supply opening projected portion 11A nor the supply opening projected portion 11A itself. In contrast, the annular foam discharging opening 13*r* is formed on the circumference of a circle whose center is at the center of the bottom portion of the foam diffusion space 3B and at the centroid 11*c* of the supply opening projected portion 11A, and thus, the centroid 13*cr* of the foam discharging opening 13*r* overlaps the centroid 11*c* of the supply opening projected portion 11A as well as the supply opening projected portion 11A. However, the foam discharging opening 13*r* itself does not overlap the supply opening projected portion 11A. Moreover, the foam discharging opening 13*r* is formed near the peripheral edge 12*s* of the bottom portion 12 of the foam diffusion space 3B along the peripheral edge 12*s*, and thus, there is a sufficient distance from the supply opening projected portion 11A.

In the example illustrated in FIG. 7(*a*), none of the foam discharging openings 13*j*, 13*k*, 13*r* overlap the supply opening projected portion 11A. Thus, a portion of the foam moving downward inside the foam diffusion space 3B impinges upon the supply opening projected portion 11A and is diffused in the horizontal direction along the bottom portion 12. Thus, the foam is discharged from each section of the plurality of foam discharging openings 13*j*, 13*k*, 13*r* onto the foam receiver 8 at an averaged-out speed, thereby being able to stably form the foam-formed product B having the planar-view shape illustrated in FIG. 7(*b*). As in the example illustrated in FIG. 7(*a*), in cases where there are a plurality of foam discharging openings 13*j*, 13*k*, 13*r* in the bottom portion 12 of the foam diffusion space 3B, some foam discharging opening(s) 13*r* may have the centroid 13*cr* thereof matching the centroid 11*c* of the supply opening projected portion 11A and/or overlapping the supply opening projected portion 11A itself, on the premise that the foam discharging openings do not overlap the supply opening projected portion 11A.

The foam discharging nozzles having, in the bottom portion of the foam diffusion space, foam discharging openings with various shapes and arrangements as illustrated in FIGS. 4(*a*), 5(*a*), 6(*a*), 7(*a*), 8(*a*), 9(*a*), 10(*a*), and 11(*a*) are preferred embodiments of the invention.

Figure 8A:
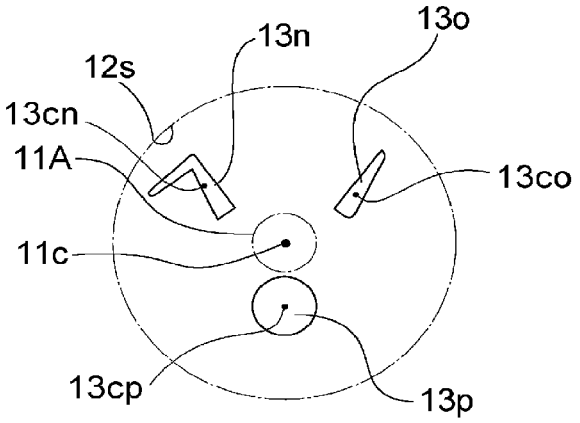
FIG. 8(*a*) is a plan view of a bottom portion of a foam diffusion space, illustrating yet another example of foam discharging openings formed in the bottom portion of the foam diffusion space, and FIG. 8(*b*) is a plan view illustrating a planar-view shape of a foam-formed product obtained by the foam discharging openings shaped and arranged as illustrated in FIG. 8(*a*).
Figure 8B:
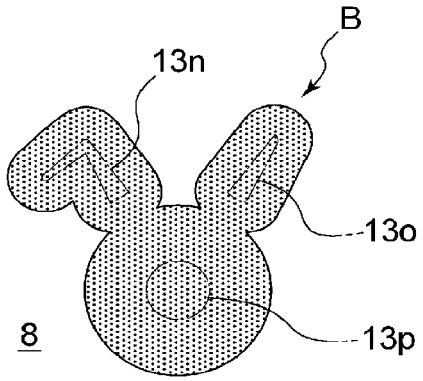

FIG. 8(*a*) illustrates yet another example of foam discharging openings formed in the bottom portion 12 of the foam diffusion space 3B. By forming foam discharging openings 13*n*, 13*o*, 13*p* shaped and arranged as illustrated in FIG. 8(*a*) in the bottom portion 12 of the foam diffusion space 3B of the foam discharging nozzle 3 of the foam discharging device 1 according to the foregoing embodiment, every time a fixed amount of foam is discharged by the foam discharging device 1 toward a foam receiver 8, a foam-formed product B having a planar-view shape like the face of a rabbit as illustrated in FIG. 8(*b*) can be formed on the foam receiver 8. Also in the example illustrated in FIG. 8(*a*), the respective centroids 13*cn*, 13*co*, 13*cp* of the foam discharging openings 13*n*, 13*o*, 13*p* neither overlap the centroid 11*c* of the supply opening projected portion 11A nor the supply opening projected portion 11A itself, and moreover, none of the foam discharging openings 13*n*, 13*o*, 13*p* overlap the supply opening projected portion 11A.

Figure 9A:
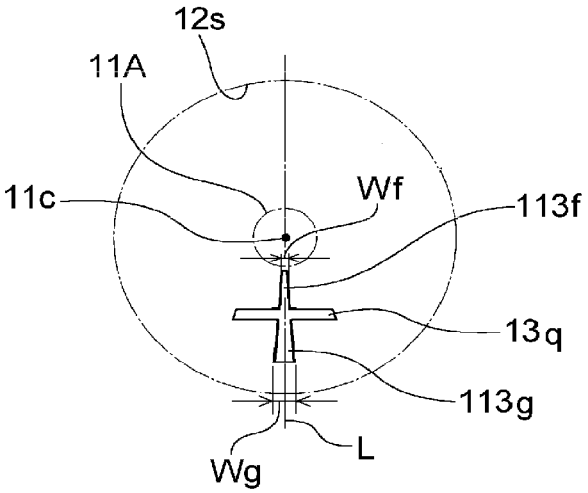
FIG. 9(*a*) is a plan view of a bottom portion of a foam diffusion space, illustrating yet another example of a foam discharging opening formed in the bottom portion of the foam diffusion space, and FIG. 9(*b*) is a plan view illustrating a planar-view shape of a foam-formed product obtained by the foam discharging opening shaped and arranged as illustrated in FIG. 9(*a*).
Figure 9B:
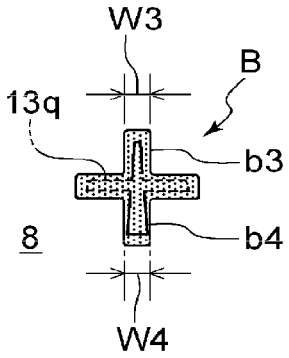

FIG. 9(*a*) illustrates another example of a foam discharging opening formed in the bottom portion 12 of the foam diffusion space 3B. By forming a foam discharging opening 13*q* shaped and arranged as illustrated in FIG. 9(*a*) in the bottom portion 12 of the foam diffusion space 3B of the foam discharging nozzle 3 of the foam discharging device 1 according to the foregoing embodiment, every time a fixed amount of foam is discharged by the foam discharging device 1 toward a foam receiver 8, a foam-formed product B having a planar-view shape of a cross as illustrated in FIG. 9(*b*) can be formed on the foam receiver 8. In FIGS. 6(*a*), 7(*a*), 8(*a*), and 9(*a*), the reference sign 12*s* indicates the position of the peripheral edge of the bottom portion 12 of the foam diffusion space 3B.

The foam discharging opening 13*q* illustrated in FIG. 9(*a*) includes a proximal portion 113*f* and a distal portion 113*g* at different distances from the centroid 11*c* of the supply opening projected portion 11A. A first portion b3 of the foam-formed product B is formed by the foam discharged from the proximal portion 113*f*, and a second portion b4 of the foam-formed product B is formed by the foam discharged from the distal portion 113*g*. As regards the width in a direction orthogonal to a straight line L passing through the centroid 11*c* of the supply opening projected portion 11A, the ratio Wf/W3 of the width Wf of the proximal portion 113*f* to the width W3 of the first portion b3 is smaller than the ratio Wg/W4 of the width Wg of the distal portion 113*g* to the width W4 of the second portion b4. By making the width Wf of the proximal portion 113*f* where the foam discharge amount tends to become large, narrower than the width Wg of the distal portion 113*g*, the amount of foam discharged from the foam discharging opening 13*q* can be made uniform, and a foam-formed product B with a desired shape can be formed even more easily. For example, as illustrated in FIG. 9(*b*), it is easy to form a foam-formed product B wherein the ratio between the first portion b3's width and the second portion b4's width is designed at a predetermined ratio (1:1 in the illustrated example).

Examples of shapes of formed products B include triangular, quadrangular, diamond-shape, star-shape, cross-shape, the shape of a heart, club, or spade in playing cards, the shape of an animal such as a rabbit, cat, elephant, or bear, the shape of the entire body, or a portion thereof such as the face, of a game character, and the shape of the contour of a flower, plant, fruit, or a vehicle such as an airplane, car, or yacht.

As illustrated in FIG. 2, the foam discharging device 1 of the present embodiment includes a second porous element 40 at the foam discharging opening 13 of the foam discharging nozzle 3. For the second porous element 40, it is possible to use, for example, a synthetic resin-made or metal-made mesh sheet, a sintered compact of metal particles, or a spongy molded product made of a synthetic resin having a three-dimensional meshed structure. One of various methods may be employed as a method for fixing the second porous element 40 to the foam discharging opening 13, such as: joining the second porous element 40 by, for example, heat sealing, ultrasonic sealing, or an adhesive, to a peripheral section surrounding the foam discharging opening 13 on the upper-end surface of the discharging opening formation member 39; or fitting, into the foam discharging opening 13, the second porous element 40 that has been formed such that the shape of its outer peripheral surface is identical to the shape of the inner peripheral surface of the foam discharging opening 13.

By providing the second porous element 40 to the foam discharging opening 13, the foam supplied from the foam supply opening 11 diffuses even more favorably in the horizontal direction within the foam diffusion space 3B, and is discharged from the foam discharging opening 13 at an averaged-out speed over the entire region of the foam discharging opening 13.

Thus, a foam-formed product B with an even clearer contour shape can be formed on the surface of a foam receiver 8, such as the palm of a person's hand. Further, the presence of the second porous element 40 provides foam with even finer bubbles, thereby further enabling the production of a foam-formed product B with a clear contour shape. The pore diameter of the second porous element 40 may be the same as or different from that of the first porous element 33.

Preferably, the area of the second porous element 40 (the area of the upper or lower surface thereof) is equal to or greater than the opening area of the foam discharging opening 13 on the foam diffusion space 3B side or the exterior side, and is more preferably greater than the opening area of the foam discharging opening 13 on the foam diffusion space 3B side. Even more preferably, in cases where the second porous element 40 is arranged on the foam diffusion space 3B side of the discharging opening formation member 39, the second porous element 40 is present on the entire surface of the discharging opening formation member 39 on the foam diffusion space 3B side. In the foam discharging device 1 of the present embodiment, the upper surface 12*a* of the bottom portion 12 of the foam diffusion space 3B is formed of the upper surface of the discharging opening formation member 39, and the second porous element 40 is arranged in a region including sections overlapping the foam discharging openings 13—preferably the entire region—on the upper surface of the discharging opening formation member 39.

The area of the second porous element 40 (the area of the upper or lower surface thereof) is preferably greater than the area of the outlet 32*d* of the gas-liquid mixing portion 32.

From the viewpoint of facilitating formation of a foam-formed product B with a clear contour shape, it is preferable that the distance h (see FIG. 2) from the first porous element 33 to the foam discharging opening 13's open portion on the hollow side is preferably 10% or greater, more preferably 20% or greater, and preferably 100% or less, more preferably 50% or less, with respect to the equivalent circle diameter of the foam diffusion space 3B as calculated from the maximum value of the cross-sectional area of the foam diffusion space 3B.

Preferably, the distance h (see FIG. 2) is smaller than the equivalent circle diameter of the foam diffusion space 3B.

As illustrated in FIG. 2, it is preferable that, as regards the foam discharging opening 13 of the foam discharging nozzle 3 of the invention, a peripheral edge portion of the foam discharging opening's open portion on the exterior side protrudes in the foam discharge direction T. The "open portion on the exterior side" refers to the open portion that is open on the opposite side from the open portion on the foam diffusion space 3B side. In a state of normal use of the foam discharging device 1, the peripheral edge portion protrudes downward of the foam discharging nozzle 3.

In the foam discharging device 1 of the present embodiment, the horizontal diffusion promoting member 38 and the discharging opening formation member 39 are connected, without bonding the boundary therebetween, by fitting a projecting rib 39*h* formed on the outer peripheral surface of the discharging opening formation member 39 into a depressed groove 38*h* formed in the inner peripheral surface of the horizontal diffusion promoting member 38. Thus, by rotating the discharging opening formation member 39 with the hand, the foam discharging opening 13's position can be changed about the rotation axis which extends in the foam discharge direction T.

For example, by allowing the orientation of the foam discharging opening 13 to be changed according to the aforementioned method, foam formed in a predetermined shape can be discharged in a desired orientation onto a foam receiver 8, such as the palm. If the orientation of the foam discharging opening 13 cannot be changed, the orientation of the foam-formed product B formed on the palm will vary depending on whether the foam discharging device 1 is placed at the back of a washbasin with the foam discharging nozzle 3 facing frontward, or the foam discharging device 1 is placed on the left of a washbasin with the foam discharging nozzle 3 facing rightward, or the foam discharging device 1 is placed on the right of a washbasin with the foam discharging nozzle 3 facing leftward. However, by making the orientation of the foam discharging opening 13 changeable and changing the orientation of the foam discharging opening 13 depending on where the foam discharging device 1 is installed, it is possible to form a foam-formed product B in the same orientation on the palm of a hand, regardless of where the foam discharging device 1 is installed.

Instead of the method of rotatably coupling the horizontal diffusion promoting member 38 and the discharging opening formation member 39, it is possible to adopt another method for making the position of the foam discharging opening 13 changeable about the rotation axis extending in the foam discharge direction T, such as a method of making the foamer case 34 and the horizontal diffusion promoting member 38 mutually rotatable, or a method of attaching the foam discharging nozzle 3 to the foam discharging device 1 such that the entire foam discharging nozzle 3 becomes rotatable.

As another method for making the position of the foam discharging opening 13 changeable about the rotation axis extending in the foam discharge direction T, the discharging opening formation member 39 may be made attachable/detachable to/from the horizontal diffusion promoting member 38, and the discharging opening formation member 39 may be turned while it is detached and then reattached with the orientation of the discharging opening 13 changed to a different orientation.

Note that the entire foam discharging nozzle 3 may be made of synthetic resin, or the entirety or a portion thereof may be formed from a material other than synthetic resin, such as metal or ceramic. Examples of synthetic resins include polyolefins such as polyethylene and polypropylene, polystyrene, polyethylene terephthalate (PET), polycarbonate, acrylic, polyamide, polyacetal, and vinyl chloride.

From the viewpoint of improving shape retainability of the foam-formed product B formed on the foam receiver 8, the gas-to-liquid ratio between air and liquid (former to latter) of the foam discharged from the foam discharging nozzle 3 is preferably from 5:1 to 100:1, more preferably from 10:1 to 50:1. Foam having the aforementioned gas-to-liquid ratio can be obtained by adjusting the speed of the gas and liquid fed to the foam discharging nozzle 3, the speed ratio therebetween, and/or the viscosity of the liquid.

From the viewpoint of improving formability of the foam-formed product B having a predetermined shape, the amount of foam (apparent volume) discharged each time is preferably 5 $cm^3$ or greater, more preferably 10 $cm^3$ or greater, and preferably 100 $cm^3$ or less, more preferably 50 $cm^3$ or less, and preferably from 5 to 100 $cm^3$, more preferably from 10 to 50 $cm^3$.

The foam discharge amount can be measured by introducing the discharged foam into a container with which volume can be measured or a container with a known volumetric capacity, such as a graduated cylinder or a measuring cup, in an environment at atmospheric temperature, humidity, and pressure (20° C., 40 RH %, 1 atmosphere).

From the viewpoint of forming stability of the discharged foam and liquid-dripping preventability, the volumetric capacity of the foam diffusion space 3B is preferably from 0.05 times to twice, more preferably from 0.1 times to once, even more preferably from 0.2 to 0.8 times, the amount of foam (apparent volume) discharged each time. In cases where the usage frequency of the foam discharging device 1 is low, it is preferable that the ratio of the volumetric capacity of the foam diffusion space 3B to the amount of foam (apparent volume) discharged each time is less than 1.

Note that the volumetric capacity of the foam diffusion space 3B is the volumetric capacity of the space from the lower surface of the first porous element 33 to the position of the foam discharging opening 13's open portion on the foam diffusion space 3B side; for example, even when, as illustrated in FIG. 2, the second porous element 40 is arranged on the upper surface of the discharging portion formation member in which the foam discharging opening 13 is opened, the volumetric capacity of the foam diffusion space 3B is calculated assuming that the second porous element 40 is not arranged. Further, in cases where a portion whose cross-sectional area at a plane orthogonal to the foam discharge direction is smaller than the area of the outlet of the gas-liquid mixing portion is provided between the lower surface of the first porous element 33 and the upper surface of the discharging portion formation member in which the foam discharging opening 13 is opened, the volumetric capacity of the foam diffusion space 3B is calculated by including the volumetric capacity of that portion.

The present invention is not limited to the foregoing embodiments, and various modifications are possible.

For example, in the foregoing embodiment, the foam discharging nozzle 3 is constituted by a plurality of members; instead, two or more members may be integrally molded, or a single integrally-molded member may be replaced by a plurality of coupled members. There may be one or a plurality of foam discharging openings 13 formed in the bottom portion 12 of the foam diffusion space 3B. In cases where there are plural openings, the foam having passed through the common foam diffusion space 3B is discharged from the plurality of foam discharging openings 13.

The centroid 11*c* of the supply opening projected portion 11A does not have to be at the center of the bottom portion 12 of the foam diffusion space 3B that has an inner peripheral surface having a circular horizontal cross-sectional shape. The horizontal cross-sectional shape of the foam diffusion space 3B does not have to have a circular planar-view shape.

The foam discharging device may be an electric-motor-type foam discharging device that starts supplying gas and liquid to the foam discharging nozzle 3 by detecting a signal from a press button or a contact-type sensor, instead of a non-contact sensor. The liquid supply mechanism may be configured such that gas is fed into the storage by, for example, an electric-motor-type air pump to cause the fed-in gas to press the liquid surface, and thereby the pressed content liquid is fed into the foam discharging nozzle 3 via a plastic tube whose one end is placed in the content liquid.

The foam discharging device of the invention may be a manual device. For example, air and liquid may be supplied to the foam generating mechanism of the foam discharging nozzle 3 by pressing and operating a pump head. Further, the foam discharging device 1 of the foregoing embodiment may be configured as an integral portable device by housing all of the constituent elements in a housing provided with a portion for placing the hand, or by holding all of the constituent elements on a base. Alternatively, the foam discharging device may be configured as a non-portable device by fixing, below a washbasin, elements other than the foam discharging nozzle and its support.

Examples of liquids other than cleaning agents, such as liquid soap, include: disinfectants for the hands and fingers, capable of being made into foam by adding an activator; cosmetics for the head and hair, such as hair grooming agents, holding agents, and hair growth agents; cosmetics for the skin, such as toners, moisturizers, and serums; shaving foams; and dishwashing detergents. The gas is usually air, but other gases, such as nitrogen or helium, may be used instead of air.

In relation to the foregoing embodiments, the invention further discloses the following additional features (foam discharging nozzles, foam discharging devices, etc.).

{1}

A foam discharging nozzle for a foam discharging device, including:

a foam diffusion space to which foam produced by mixing a liquid and a gas is supplied from a foam supply opening located on an upper side; and at least one foam discharging opening formed in a bottom portion of the foam diffusion space, wherein:

an area of the bottom portion of the foam diffusion space is wider than an area of the foam supply opening; and a centroid of the foam discharging opening does not match a centroid of a supply opening projected portion formed by projecting the foam supply opening onto the bottom portion parallel to a central axis of the foam diffusion space.

{2}

The foam discharging nozzle as set forth in clause {1}, wherein an area of a portion in which the foam discharging opening and the supply opening projected portion overlap one another is from 0 to 30% of an area of the foam discharging opening.

{3}

The foam discharging nozzle as set forth in clause {1} or {2}, wherein an area of a portion in which the foam discharging opening and the supply opening projected portion overlap one another is from 0 to 10% of an area of the foam discharging opening.

{4}

The foam discharging nozzle as set forth in any one of clauses {1} to {3}, wherein the centroid of the foam discharging opening does not overlap the supply opening projected portion.

{5}

The foam discharging nozzle as set forth in clause {4}, wherein the foam discharging opening does not overlap the supply opening projected portion.

{6}

A foam discharging nozzle for a foam discharging device, including:

a foam diffusion space to which foam produced by mixing a liquid and a gas is supplied from a foam supply opening located on an upper side; and at least one foam discharging opening formed in a bottom portion of the foam diffusion space, wherein:

an area of the bottom portion of the foam diffusion space is wider than an area of the foam supply opening; and the foam discharging opening does not overlap a supply opening projected portion formed by projecting the foam supply opening onto the bottom portion parallel to a central axis of the foam diffusion space.

{7}

The foam discharging nozzle as set forth in any one of clauses {1} to {6}, wherein the foam discharging nozzle includes, as the foam discharging opening, a plurality of the foam discharging openings which are separated from one another.

{8}

The foam discharging nozzle as set forth in clause {7}, wherein:

the foam discharging nozzle is capable of forming, on a foam receiver, a foam-formed product including a large area portion and a small area portion that have different sizes from one another in a planar view;

the foam discharging nozzle includes, as the foam discharging opening, a first discharging opening to discharge foam for forming the large area portion, and a second discharging opening to discharge foam for forming the small area portion; and the distance between the first discharging opening and the centroid of the supply opening projected portion is shorter than the distance between the second discharging opening and the centroid of the supply opening projected portion.

{9}

The foam discharging nozzle as set forth in clause {7} or {8}, wherein:

the foam discharging nozzle is capable of forming, on a foam receiver, a foam-formed product including a large area portion and a small area portion that have different sizes from one another in a planar view;

the foam discharging nozzle includes, as the foam discharging opening, a first discharging opening to discharge foam for forming the large area portion, and a second discharging opening to discharge foam for forming the small area portion; and the first discharging opening and the second discharging opening are formed so as to satisfy the following equation (1):

[Math. 2]

$$\frac{Gb}{Ga} = \alpha \times \frac{Sb \times La}{Sa \times Lb} \quad (1)$$

wherein Ga is the area of the large area portion, Gb is the area of the small area portion, Sa is the area of the first discharging opening, La is the distance between the centroid of the first discharging opening and the centroid of the supply opening projected portion, Sb is the area of the second discharging opening, Lb is the distance between the centroid of the second discharging opening and the centroid of the supply opening projected portion, and α is a real number from 0.1 to 2 inclusive.

{10}

The foam discharging nozzle as set forth in any one of clauses {1} to {6}, wherein the foam discharging opening has a configuration in which a plurality of main discharging portions are connected together via a narrow-width boundary discharging portion.

{11}

The foam discharging nozzle as set forth in clause {10}, wherein:

the foam discharging nozzle is capable of forming, on a foam receiver, a foam-formed product including a large area portion and a small area portion that have different sizes from one another in a planar view;

the main discharging portion includes a first discharging portion to discharge foam for forming the large area portion mainly, and a second discharging portion to discharge foam for forming the small area portion mainly; and the distance between the first discharging portion and the centroid of the supply opening projected portion is shorter than the distance between the second discharging portion and the centroid of the supply opening projected portion.

{12}

The foam discharging nozzle as set forth in any one of clauses {1} to {11}, wherein:

the foam discharging nozzle includes, as the foam discharging opening, a foam discharging opening including a proximal portion and a distal portion at different distances from the centroid of the supply opening projected portion, and thereby a first portion of the foam-formed product is formed by foam discharged from the proximal portion, and a second portion of the foam-formed product is formed by foam discharged from the distal portion; and as regards a width in a direction orthogonal to a straight line passing through the centroid of the supply opening projected portion, the ratio of the width of the proximal portion to the width of the first portion is smaller than the ratio of the width of the distal portion to the width of the second portion.

{13}

The foam discharging nozzle as set forth in any one of clauses {1} to {12}, wherein a porous element is provided to the foam discharging opening.

{14}

The foam discharging nozzle as set forth in any one of clauses {1} to {13}, wherein the position of the foam discharging opening is changeable about a central axis of the foam discharging nozzle.

{15}

The foam discharging nozzle as set forth in any one of clauses {1} to {14}, wherein the foam discharging device is an electric-motor-type or pump-type fixed-amount discharging device to discharge a fixed amount of foam from the foam discharging nozzle by supplying a fixed amount of foam to the foam diffusion space.

{16}

The foam discharging nozzle as set forth in any one of clauses {1} to {15}, wherein the foam discharging nozzle includes a foam generating mechanism.

{17}

The foam discharging nozzle as set forth in clause {16}, wherein the foam discharging nozzle includes a foam generating mechanism including: a gas-liquid mixing portion in which liquid and gas are mixed; and a porous element arranged to the foam supply opening.

{18}

The foam discharging nozzle as set forth in any one of clauses {1} to {17}, wherein the cross-sectional area of the foam diffusion space at a plane orthogonal to the central axis of the foam diffusion space is larger than the area of the foam supply opening.

{19}

The foam discharging nozzle as set forth in any one of clauses {1} to {18}, wherein: the opening area of the foam discharging opening on the foam diffusion space side is smaller than the maximum value of the cross-sectional area of the foam diffusion space; and one or a plurality of the foam discharging openings for discharging the foam having passed through the foam diffusion space to the exterior is/are provided in the bottom portion of the foam diffusion space.

{20}

The foam discharging nozzle as set forth in clause {13}, wherein: the upper surface of the bottom portion of the foam diffusion space is formed of an upper surface of a discharging opening formation member; and the porous element is arranged in a region including a section overlapping the foam discharging opening on the upper surface of the discharging opening formation member.

{21}

A foam discharging device including the foam discharging nozzle as set forth in any one of clauses {1} to {20}.

{22}

The foam discharging device as set forth in clause {21}, wherein the foam discharging device is an electric-motor-type or pump-type fixed-amount discharging device to discharge a fixed amount of foam from the foam discharging nozzle by supplying a fixed amount of foam to the foam diffusion space.

INDUSTRIAL APPLICABILITY

According to the foam discharging nozzle and the foam discharging device of the invention, foam-formed products can be stably formed into desired shapes.

The invention claimed is:

1. A foam discharging nozzle for a foam discharging device being capable of forming, on a foam receiver, a foam-formed product, and comprising:

a foam diffusion space to which foam produced by mixing a liquid and a gas is supplied from a foam supply opening located on an upper side; and at least one foam discharging opening formed in a bottom portion of the foam diffusion space, wherein:

an area of the bottom portion of the foam diffusion space is wider than an area of the foam supply opening; and a centroid of the foam discharging opening does not match a centroid of a supply opening projected portion formed by projecting the foam supply opening onto the bottom portion parallel to a central longitudinal axis of the foam diffusion space, wherein the supply opening projected portion has a longitudinal axis that runs through a center thereof that is coaxial relative to the central longitudinal axis of the foam diffusion space, and wherein a porous element is provided in abutment with the foam discharging opening.

2. The foam discharging nozzle according to claim 1, wherein an area of a portion in which the foam discharging opening and the supply opening projected portion overlap one another is from 0 to 30% of an area of the foam discharging opening.

3. The foam discharging nozzle according to claim 1, wherein the centroid of the foam discharging opening does not overlap the supply opening projected portion.

4. The foam discharging nozzle according to claim 3, wherein the foam discharging opening does not overlap the supply opening projected portion.

5. A foam discharging nozzle for a foam discharging device being capable of forming, on a foam receiver, a foam-formed product, and comprising:

a foam diffusion space to which foam produced by mixing a liquid and a gas is supplied from a foam supply opening located on an upper side; and at least one foam discharging opening formed in a bottom portion of the foam diffusion space, wherein:

an area of the bottom portion of the foam diffusion space is wider than an area of the foam supply opening; and the foam discharging opening does not overlap a supply opening projected portion formed by projecting the foam supply opening onto the bottom portion parallel to a central longitudinal axis of the foam diffusion space, wherein the supply opening projected portion has a longitudinal axis that runs through a center thereof that is coaxial relative to the central longitudinal axis of the foam diffusion space, and wherein a porous element is provided in abutment with the foam discharging opening.

6. The foam discharging nozzle according to claim 1, wherein the foam discharging nozzle comprises, as the foam discharging opening, a plurality of the foam discharging openings which are separated from one another.

7. The foam discharging nozzle according to claim 6, wherein:

the foam discharging nozzle is capable of forming, on a foam receiver, a foam-formed product including a large area portion and a small area portion that have different sizes from one another in a planar view;

the foam discharging nozzle comprises, as the foam discharging opening, a first discharging opening to discharge foam for forming the large area portion, and a second discharging opening to discharge foam for forming the small area portion; and the distance between the first discharging opening and the centroid of the supply opening projected portion is shorter than the distance between the second discharging opening and the centroid of the supply opening projected portion.

8. The foam discharging nozzle according to claim 6, wherein:

the foam discharging nozzle is capable of forming, on a foam receiver, a foam-formed product including a large area portion and a small area portion that have different sizes from one another in a planar view;

the foam discharging nozzle comprises, as the foam discharging opening, a first discharging opening to discharge foam for forming the large area portion, and a second discharging opening to discharge foam for forming the small area portion; and the first discharging opening and the second discharging opening are formed so as to satisfy the following equation (1):

$$\frac{Gb}{Ga} = \alpha \times \frac{Sb \times La}{Sa \times Lb} \tag{1}$$

wherein Ga is the area of the large area portion, Gb is the area of the small area portion, Sa is the area of the first discharging opening, La is the distance between the centroid of the first discharging opening and the centroid of the supply opening projected portion, Sb is the area of the second discharging opening, Lb is the distance between the centroid of the second discharging opening and the centroid of the supply opening projected portion, and a is a real number from 0.1 to 2 inclusive.

9. The foam discharging nozzle according to claim 1, wherein the foam discharging opening has a configuration in which a plurality of main discharging portions are connected together via a narrow-width boundary discharging portion.

10. The foam discharging nozzle according to claim 9, wherein:

the foam discharging nozzle is capable of forming, on a foam receiver, a foam-formed product including a large area portion and a small area portion that have different sizes from one another in a planar view;

the main discharging portion comprises a first discharging portion to discharge foam for forming the large area portion, and a second discharging portion to discharge foam for forming the small area portion; and the distance between the first discharging portion and the centroid of the supply opening projected portion is shorter than the distance between the second discharging portion and the centroid of the supply opening projected portion.

11. The foam discharging nozzle according to claim 1, wherein:

the foam discharging nozzle comprises, as the foam discharging opening, a foam discharging opening including a proximal portion and a distal portion at different distances from the centroid of the supply opening projected portion, and thereby a first portion of the foam-formed product is formed by foam discharged from the proximal portion, and a second portion of the foam-formed product is formed by foam discharged from the distal portion; and as regards a width in a direction orthogonal to a straight line passing through the centroid of the supply opening projected portion, the ratio of the width of the proximal portion to the width of the first portion is smaller than the ratio of the width of the distal portion to the width of the second portion.

12. The foam discharging nozzle according to claim 1, wherein the position of the foam discharging opening is changeable about a central axis of the foam discharging nozzle.

13. The foam discharging nozzle according to claim 1, wherein a peripheral edge portion of the foam discharging opening's open portion on the exterior side protrudes in the foam discharge direction.

14. The foam discharging nozzle according to claim 1, wherein the foam discharging device is an electric-motor-type or pump-type fixed-amount discharging device to discharge a fixed amount of foam from the foam discharging nozzle by supplying a fixed amount of foam to the foam diffusion space.

15. A foam discharging device comprising the foam discharging nozzle according to claim 1.

16. The foam discharging device according to claim 15, wherein the foam discharging device is an electric-motor-type or pump-type fixed-amount discharging device to discharge a fixed amount of foam from the foam discharging nozzle by supplying a fixed amount of foam to the foam diffusion space.

17. The foam discharging nozzle according to claim 1, wherein the porous element is a synthetic resin-made or metal-made mesh sheet, or a sintered compact of metal particles.

* * * * *